US007325947B2

(12) United States Patent
Floyd et al.

(10) Patent No.: US 7,325,947 B2
(45) Date of Patent: Feb. 5, 2008

(54) HIGH INTENSITY DISCHARGE LIGHTING FIXTURE

(75) Inventors: Jerry D. Floyd, Centerville, TN (US); Robert L. Towe, Fairview, TN (US); Michael S. Swabe, Dickson, TN (US)

(73) Assignee: France/A Scott Fetzer Company, Fairview, TN (US)

( * ) Notice: Subject to any disclaimer, the term of this patent is extended or adjusted under 35 U.S.C. 154(b) by 251 days.

(21) Appl. No.: 11/097,046

(22) Filed: Apr. 1, 2005

(65) Prior Publication Data

US 2005/0219846 A1 Oct. 6, 2005

Related U.S. Application Data

(60) Provisional application No. 60/559,118, filed on Apr. 2, 2004.

(51) Int. Cl.
*F21V 29/00* (2006.01)

(52) U.S. Cl. ..... 362/264; 362/294; 362/812; 40/564

(58) Field of Classification Search ..... 362/264, 362/265, 294, 373, 812; 40/564, 573
See application file for complete search history.

(56) References Cited

U.S. PATENT DOCUMENTS 3,459,934 A * 8/1969 Moore ..... 362/294
4,414,615 A * 11/1983 Szeker et al. ..... 362/264
4,845,604 A 7/1989 Holman ..... 362/431
5,278,745 A 1/1994 Kelly et al. ..... 362/374
5,434,765 A 7/1995 Kelly et al. ..... 362/274
6,497,499 B1 * 12/2002 Fischer et al. ..... 362/265
2003/0147240 A1 8/2003 Gordin et al.

OTHER PUBLICATIONS

France of Fairview Tennessee, *HID Sign Bright*, Product Literature Published Oct. 7, 2003.

* cited by examiner

*Primary Examiner*—Stephen F Husar
(74) *Attorney, Agent, or Firm*—Wood, Herron & Evans LLP

(57) ABSTRACT

A lamp fixture for mounting a high intensity discharge (HID) lamp. The lamp fixture integrates components needed to operate the HID lamp, including a lamp socket and a ballast, into a compact assembly covered by an enclosure. The fixture facilitates dissipation of heat from the lamp and ballast through a base mounting so that thermal insulation of the ballast transformed is not required, thereby reducing the weight of the device. The fixture may further include a diffuser mounted to the enclosure to distribute light from the HID lamp in a uniform manner. The fixture is particularly useful for mounting HID lamps within illuminated signs.

15 Claims, 4 Drawing Sheets

HIGH INTENSITY DISCHARGE LIGHTING FIXTURE

This application claims priority to U.S. patent application Ser. No. 60/559,118 (pending) filed Apr. 2, 2004, and incorporated by reference herein in its entirety.

FIELD OF THE INVENTION

The present invention relates generally to lighting systems, and more particularly to a high intensity discharge lighting system for use with illuminated signs.

BACKGROUND OF THE INVENTION

Illuminated signs are widely used by businesses and other entities to indicate the location of a place of business or to display information to the public in a manner that may be readily seen at nighttime or during other periods of low light. While many forms of illuminated signs are known, one popular and economic method of providing an illuminated sign involves the use of high intensity discharge (HID) lamps in conjunction with transparent or translucent sign panels having visible indicia mounted or otherwise disposed on the surface of the panels. The HID lamp is positioned behind the sign panel and light is transmitted through the panel to illuminate the sign.

HID lamps are known in the art and operate by creating an arc between metal electrodes to produce high levels of intense light from a relatively small source. HID lamps are relatively energy efficient and provide long service life. Similar to fluorescent lamps, HID lamps require a ballast to aid in starting and maintaining operation of the lit lamp. Because HID lamps require high-voltage electricity and emit heat and ultraviolet radiation, manufacture and use of HID illuminated signs are covered by various codes, such as the National Electric Code, and standards, such as those developed by organizations such as Underwriters Laboratories, Inc. (UL®).

To fabricate an HID illuminated sign, a manufacturer typically obtains lamp components, such as HID lamp sockets and ballasts, and integrates the individual components into a sign support structure according to guidelines such as those established by the UL® standards. Accordingly, fabrication of each illuminated sign essentially involves assembling the HID lamp components from scratch, largely because the UL® requirements have made it difficult to integrate the components into a modular fixture which may be used for all sign configurations. In particular, integrating the components into a single fixture makes it difficult to dissipate heat generated by the HID lamp and the ballast in accordance with UL® standards. To better control the heat, transformers are often potted in an insulative material, such as asphalt, and therefore the assemblies are very heavy.

One commercially available lighting fixture is a perimeter lighting system that is configured to be mounted within the interior of an illuminated sign at locations around the peripheral edge of the sign. Accordingly, one drawback of this lighting fixture is that the light is concentrated toward the outer periphery of the sign and therefore does not uniformly light interior portions of the sign. The fixture requires a lens to help direct light toward the center of the sign and is also relatively heavy and expensive. Other conventional HID luminaires are generally unacceptable for illuminating interiorly lit signs because such luminaires are configured to provide highly directional lighting, whereas the objective of illuminated signs is to provide as much light as possible in every direction A need therefore exists for a lightweight, economical fixture for mounting HID lamps which is convenient for use in illuminated signs.

SUMMARY OF THE INVENTION

The present invention provides a lamp fixture for mounting high intensity discharge, or HID, lamps. The lamp fixture integrates all of the components needed to start and maintain operation of the HID lamp, including a lamp socket and a ballast, into a single, compact assembly. In one embodiment, the lamp fixture includes a mounting base to which all of the components are secured, and a housing cover which may be secured to the base to enclose the fixture components. The mounting base includes mounting flanges which facilitate securing the lamp fixture to the framework of an illuminated sign.

In another embodiment, the lamp fixture includes several heat shields secured to the mounting base to divide the lamp fixture into individual compartments for housing the lamp socket and the ballast. The ballast includes a conventional core and coil-type transformer and an oil-filled capacitor. The heat shields also separate the transformer from the capacitor. Advantageously, the heat shields prevent heat from the HID lamp from overheating the transformer.

In another embodiment, the mounting base includes a heavy steel bottom plate for dissipating heat generated by the fixture. The transformer is mounted to the mounting base such that it is firmly in contact with the bottom plate to optimize conductive heat transfer from the transformer to the mounting base. The housing cover also includes louvered vents which cooperate with the mounting base and heat shields to manage the thermal characteristics of the lamp fixture, and to dissipate heat generated by the HID lamp and the transformer.

In yet another embodiment, the lamp fixture includes a diffuser mounted to the housing cover, proximate the HID lamp. The diffuser helps to evenly distribute light from the HID lamp and, when used with an illuminated sign, helps to alleviate bright spots on the sign panels adjacent the HID lamp.

In another embodiment, an outdoor, illuminated sign includes a sign support frame, at least one transparent or translucent sign panel mounted to the frame, at least one lamp fixture mounted to the sign frame, and an HID lamp installed in the lamp fixture.

The features and objectives of the present invention will become more readily apparent from the following Detailed Description taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
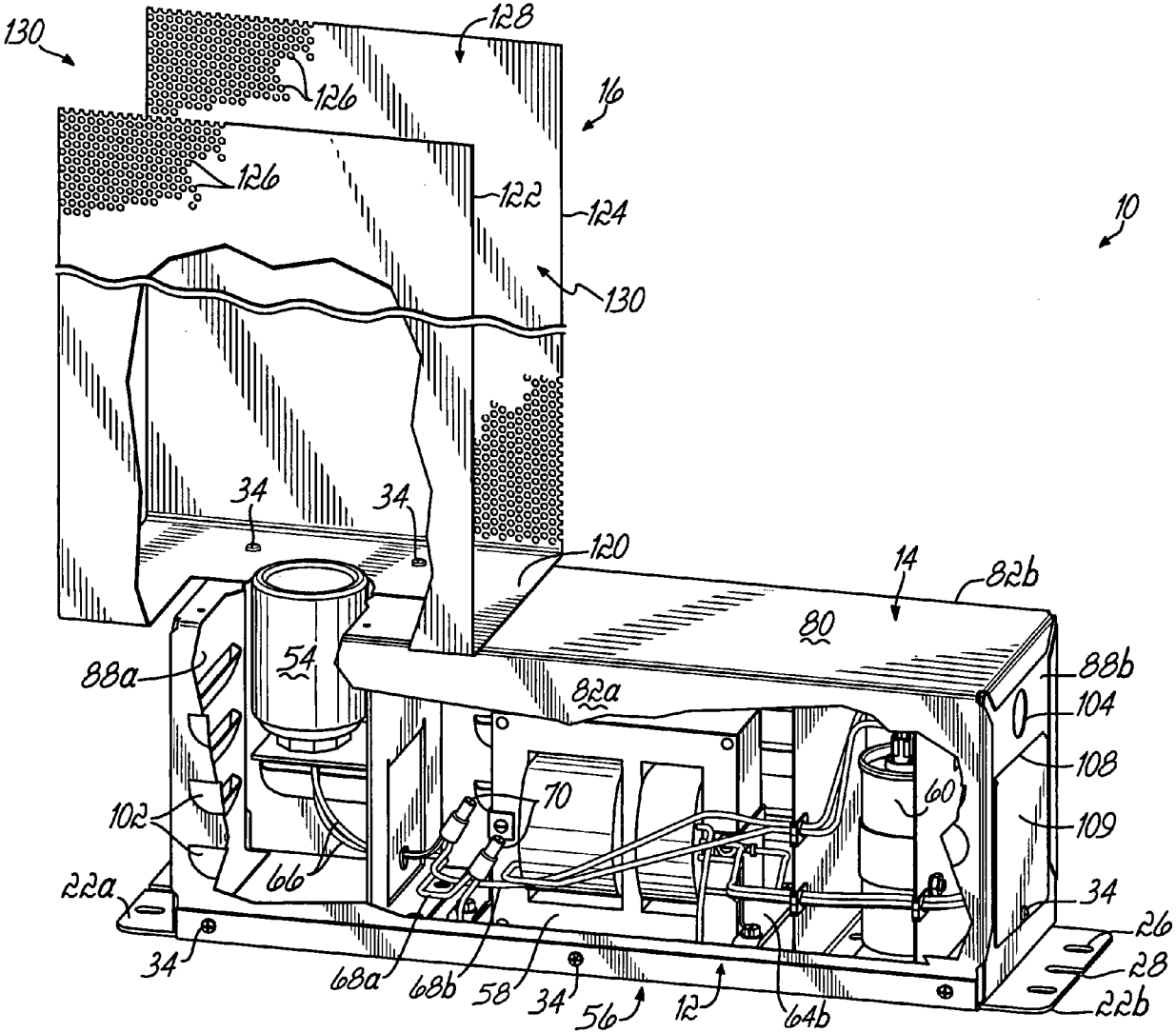
FIG. 1 is a perspective view of an exemplary HID lamp fixture according to the present invention, with broken sections depicting detail of fixture components.

Referring to FIG. 1, there is shown an exemplary high intensity discharge (HID) lamp fixture 10, according to the present invention. The HID lamp fixture 10 includes a mounting base 12, which supports various components of the lamp fixture 10, as will be discussed more fully below. A housing cover 14 is secured to the mounting base 12 to enclose the lamp components. The lamp fixture 10 may further include an optional diffuser 16 which may be secured to the fixture 10, generally atop the housing cover 14.

Figure 2A:
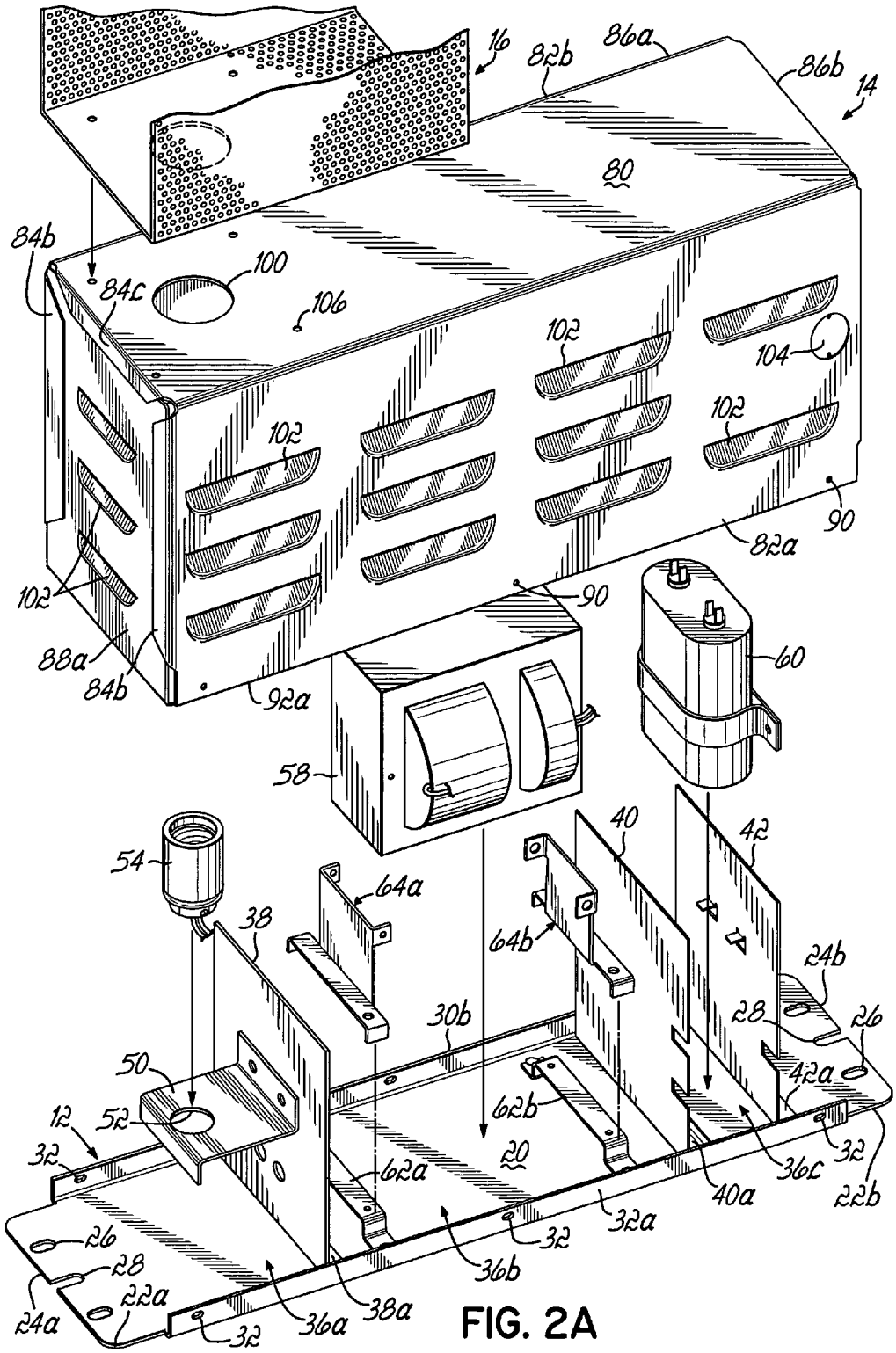
FIG. 2A is an exploded perspective view of the HID lamp fixture of FIG. 1.
Figure 2B:
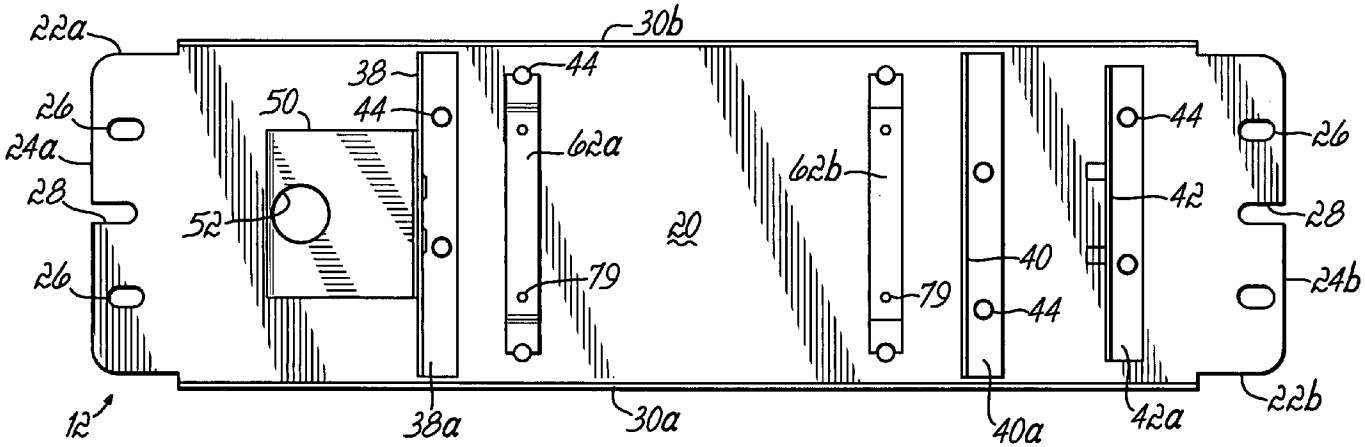
FIG. 2B is a top plan view of the mounting base of FIG. 2A.
Figure 2C:
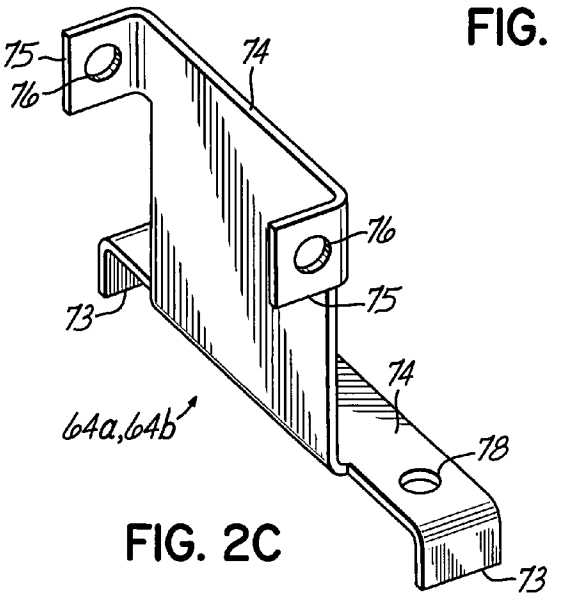
FIG. 2C is a perspective view of a transformer bracket used with the mounting base of FIG. 2A.

With continued reference to FIG. 1, and referring further to FIGS. 2A, 2B and 2C, the mounting base 12 includes a bottom plate 20 upon which the lamp components are mounted. In one embodiment, the bottom plate 20 is stamped from sheet metal, however, it will be recognized that the bottom plate 20, as well as the rest of mounting base 12, may be formed from other materials and by other methods. Flanges 22*a*, 22*b* are provided at respective longitudinal ends 24*a*, 24*b* of the mounting base 12. Slots 26 and/or apertures 28 are formed through the flanges 22*a*, 22*b* for receiving bolts or other fasteners to facilitate securing the mounting base 12 to a support surface. A pair of sidewalls 30*a*, 30*b* are formed along oppositely facing lateral side edges of the mounting base 12 and apertures 32 are formed therethrough for receiving fasteners 34, which may used to secure the housing cover 14 to the mounting base 12, as depicted in FIG. 1.

The bottom plate 20 of the mounting base 12 is separated into individual compartments 36*a*, 36*b*, 36*c* by three upstanding heat shields 38, 40, 42 secured to the bottom plate 20. In the exemplary embodiment shown, the heat shields 38, 40, 42 comprise generally rectangular steel plates having angled lower edges 38*a*, 40*a*, 42*a* for securing the heat shields 38, 40, 42 to the bottom plate 20 such as by spot welds 44 applied to the angled edges 38*a*, 40*a*, 42*a* and the bottom as shown most clearly in FIG. 2B.

A mounting shelf 50 is secured on one side of the first heat shield 38 and has an aperture 52 sized to receive a ceramic lamp socket 54 for mounting the HID lamp. The lamp fixture 10 further includes a ballast 56, for starting and maintaining illumination of an HID lamp installed in the lamp socket 54. The ballast 56 includes a conventional core and coil type transformer 58 secured to the bottom plate 20 between the first and second heat shields 38, 40, and an oil-filled capacitor 60 secured to the base plate 20 between the second and third heat shields 40, 42. To facilitate heat transfer from the transformer 58 to the bottom plate 20, the transformer 58 is firmly seated against the bottom plate 20 by a pair of mounting brackets 62*a*, 62*b* secured to the bottom plate 20 and cooperating with corresponding brackets 64*a*, 64*b* attached to the transformer 58.

Transformer brackets 64*a*, 64*b* are shown more clearly in FIG. 2C, and each comprises an elongate lower bracket portion 72 having downturned ends 73. A plate-like upper bracket portion 74 extends upwardly from a side edge of the lower bracket portion 72. A pair of spaced tabs 75 are formed on opposite sides of the top end of the upper bracket portion 74 to receive an end portion of the transformer 58 therebetween. Apertures 76 formed through the tabs 75 facilitate securing the brackets 64*a*, 64*b* to the transformer 58 with threaded fasteners. Additional apertures 78 formed through the lower bracket portion 72, near the downturned ends 73, are sized to receive threaded fasteners inserted therethrough to engage corresponding apertures 79 formed through mounting brackets 62*a*, 62*b* when transformer brackets 64*a*, 64*b* are arranged to straddle the mounting brackets 62*a*, 62*b*. Advantageously, the threaded fasteners inserted through aligned apertures 78 and 79 may be adjusted to draw the transformer 58 firmly against the bottom plate 20 so that conductive heat transfer between the bottom plate 20 and the transformer 58 is maximized.

The lamp socket 54, the transformer 58 and the capacitor 60 are electrically coupled by appropriate wiring as known in the art. Advantageously, wire leads 66 from the lamp socket 54 are coupled to wires 68*a*, 68*b* from the transformer 58 and capacitor 60 of the ballast 56 by 1,000 volt-rated closed-end crimp connectors 70. The lamp fixture 10 is provided with various wire leads for connecting the ballast 56 to 120, 208, 240, and 277 volt AC sources. When the housing cover 14 is secured to the mounting base 12, as depicted in FIG. 1, the first, second and third heat shields 38, 40, 42 thermally insulate the lamp socket 54, transformer 58 and capacitor 60, and help to dissipate heat to the bottom plate 20.

With continued reference to FIGS. 1 and 2A, the housing cover 14 of the lamp fixture 10 will now be described. In the embodiment shown, the housing cover 14 is a generally box-shaped enclosure having an open end for receiving the components of the lamp fixture 10 therein when the housing cover 14 is fitted over the mounting base 12 as depicted in FIG. 1. The mounting cover 14 includes a top wall 80 positioned generally opposite the mounting base 12, and a pair of confronting sidewalls 82*a*, 82*b* extending generally downward from opposite lateral side edges of the top wall 80. The top wall 80 and first and second sidewalls 82*a*, 82*b* of the housing cover 14 have bent edge portions 84*a*, 84*b*, 84*c* provided on respective longitudinal ends 86*a*, 86*b* whereby first and second end plates. 88*a*, 88*b* may be secured to the top wall 80 and sidewalls 82*a*, 82*b*, for example by spotwelding. Several apertures 90 are formed through the bottom ends 92*a*, 92*b* of the first and second sidewalls 82*a*, 82*b* to facilitate securing the housing cover 14 to the mounting base 12, such as with screw fasteners 34, as depicted in FIG. 1.

The top wall 80 also includes an aperture 100 formed proximate the location of the lamp socket 54 so that when the housing cover 14 is fitted to the mounting base 12, the end of the lamp socket 54 protrudes above the top wall 80 to facilitate installing an HID lamp within the lamp socket 54 while the remainder of the lamp socket 54 is recessed within the housing cover 14. The recessed configuration of the lamp socket 54 gives the fixture 10 a low-profile that facilitates installation in tight spaces and makes retrofitting older sign units with the lamp fixture 10 easier. To facilitate heat dissipation, a plurality of louvered vents 102 are formed in the first and second sidewalls 82*a*, 82*b* and in the first end panel 88*a* of the housing cover 14. The housing cover 14 may further include perforated knock-outs 104 formed in the top wall 80, sidewalls 82*a*, 82*b* or end panels 88*a*, 88*b* to facilitate creating openings through which various electrical connections may be routed through the housing cover 14 to the components of the lamp fixture 10.

An access opening 108 is formed through the second end panel 88*b* to provide user access to a compartment behind the third heat shield 42 so that wiring connections can be easily accomplished. The access opening 108 is covered by an access panel 109 removably secured to end plate 88*b* by a fastener 34, as depicted in FIG. 1. Top wall 80 also includes several small apertures 106 disposed generally around the lamp socket aperture 100 to facilitate mounting a diffuser 16 atop the housing cover 14, as depicted in FIG. 1. In the embodiment shown, the hole pattern of the small apertures 106 is configured to correspond to holes formed through the diffuser 16 such that the diffuser 16 may be mounted atop the housing cover 14 in a desired orientation.

As shown in FIG. 1, the lamp fixture 10 may further include a diffuser 16 which may be coupled adjacent the HID lamp socket 54 to facilitate evenly distributing light emitted from an HID lamp (not shown). In the exemplary embodiment shown, the diffuser 16 is a generally unshaped member having a bottom wall 120 and a pair of upstanding, confronting sidewalls 122, 124 extending generally upwardly from the bottom wall 120. Apertures 126 formed through the sidewalls 122, 124 of the diffuser 16 help to diffuse light that is emitted from the lamp in a direction directly toward the surfaces of the sidewalls 122, 124. When arranged in a sign structure with the sidewalls 122, 124 substantially parallel to the sign panels, the diffuser 16 provides a buffer between the bright light source of the lamp and the sign face. The open top 128 and side ends 130 of the diffuser 16 permit light to freely emanate from the HID lamp along directions parallel to the sidewalls 122, 124. In one embodiment, the surfaces of the diffuser 16 are painted gloss white to increase the efficiency of light reflected from the sidewalls 122, 124 and bottom wall 120 and to reduce light absorption into the diffuser 16 itself. While the diffuser 16 is depicted having a plurality of circular apertures 126 in a closely spaced arrangement, it will be recognized that apertures in various other shapes, such as differently sized holes or slots, may be formed in various other patterns through the diffuser 16 to obtain various levels of light diffusion, as may be desired.

Figure 4:
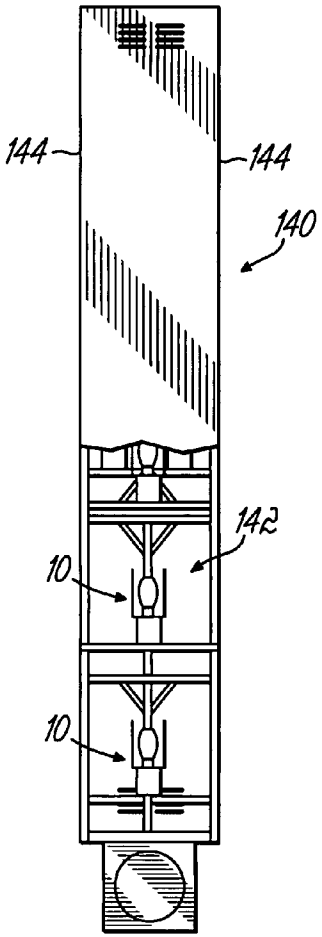
FIG. 4 is a side elevational view of the sign of FIG. 3.
Figure 3:
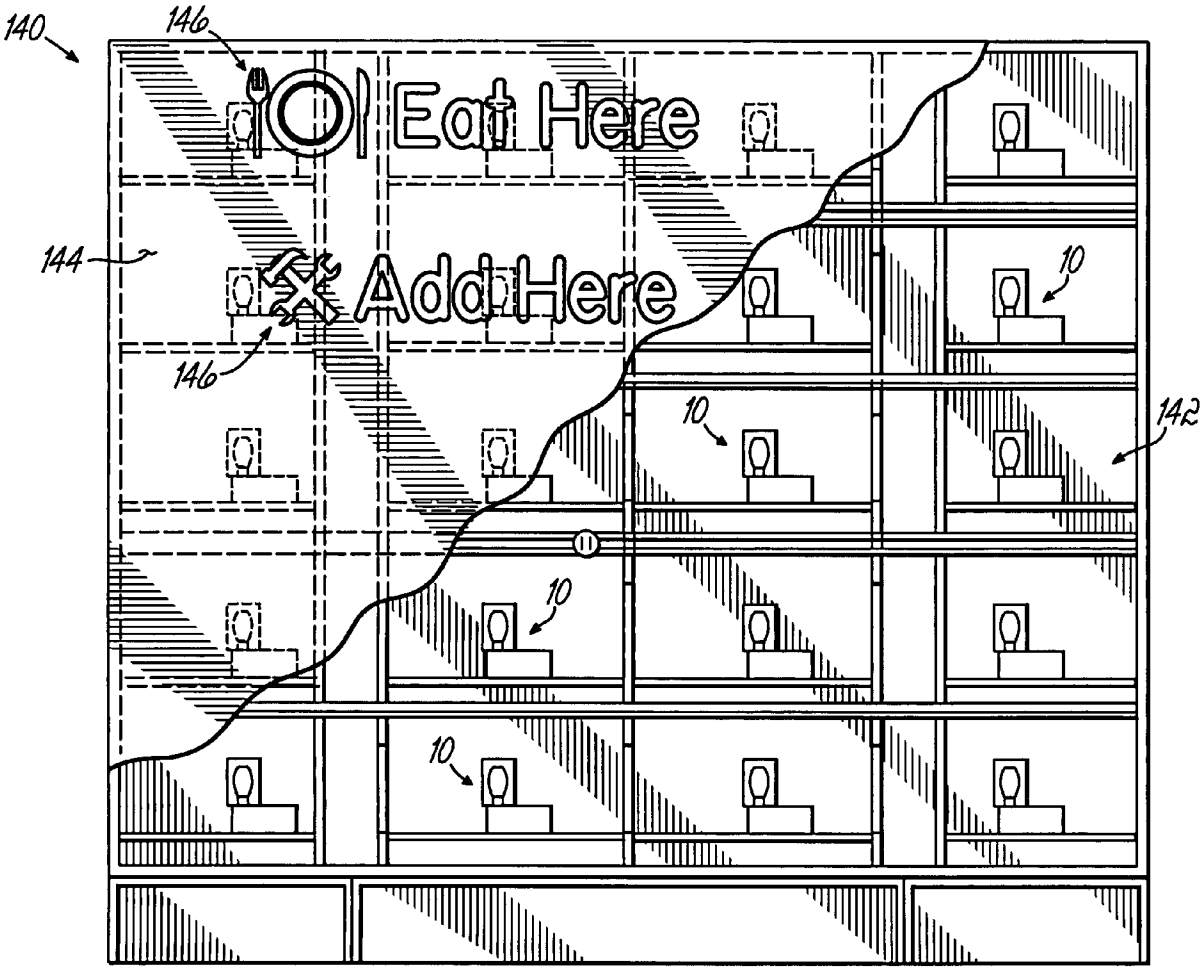
FIG. 3 depicts a front elevational view of a typical illuminated sign in which the lamp fixture of FIG. 1 is used.

Referring now to FIGS. 3 and 4, there is shown an exemplary illuminated sign 140 incorporating high intensity discharge lamps in lamp fixtures 10 as described above. The sign 140 comprises a sign support frame 142 to which a pair of spaced confronting sign panels 144 are mounted. The sign panels 144 are translucent or transparent to permit light emanating from a central portion of the sign 140 to be transmitted through the panels 144 and thereby illuminate the sign 140. Various indicia 146 in the form of letters, number or symbols are disposed on the sign panels 144 as known in the art. The internal structure of the sign support frame 142 is depicted. Several HID lamp fixtures 10, as described above, are secured to the sign support frame 142 at various spaced locations within the interior of the sign perimeter. For example, the fixtures 10 may be spaced and arranged within the frame 142 such that the lamp centers are located at 4-foot horizontal and vertical distances from one another. It will be recognized that various other arrangements for supporting and spacing the HID lamp fixtures 10 throughout the interior of the sign 140 are possible. Advantageously, the support base 12 of the lamp fixture 10 permits the lamp fixture 10 to be secured to the sign support 142 in a variety of ways such as by bolting, clamping, or otherwise fastening the support base 12 to the sign support frame 142.

The HID lamp fixture 10 of the present invention provides a compact, integral unit that facilitates mounting HID lamps within illuminated sign systems. Advantageously the mounting base 12, in conjunction with the heat shields 38, 40, 42 and louvered vents 102 on the housing cover provides superior heat dissipation from the fixture 10, while maintaining the temperature of the ballast 56 at appropriate levels so that thermal insulation of the ballast 56, typically accomplished by insulative potting material, is not necessary. This results in a ballast 56 which is much more lightweight compared to conventional ballast configurations used in HID lighting applications. Accordingly, the lamp fixture 10 is lighter in weight than the assembled components typically used by sign manufacturers in a conventional HID illuminated signs.

While the present invention has been illustrated by the description of one or more embodiments thereof, and while the embodiments have been described in considerable detail, they are not intended to restrict or in any way limit the scope of the appended claims to such detail. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope or spirit of Applicant's general inventive concept.

What is claimed is:

1. An integrated fixture for a high intensity discharge lamp, comprising:

a mounting base;

a high intensity discharge lamp socket mounted on said mounting base;

a lamp ballast secured to said mounting base and operatively coupled to said lamp socket, said lamp ballast including a transformer and a capacitor;

a first heat shield secured to said mounting base and disposed between said lamp socket and said lamp ballast; and a second heat shield secured to said mounting base and disposed between said transformer and said capacitor.

2. The integrated fixture of claim 1, wherein said ballast is thermally non-insulated.

3. The integrated fixture of claim 1, wherein said ballast comprises a core and coil type transformer and an oil-filled capacitor.

4. The integrated fixture of claim 3, further comprising brackets coupled between said mounting base and said transformer, said brackets firmly seating said transformer against said mounting base to optimize conductive heat transfer from said transformer to said mounting base.

5. The integrated fixture of claim 1, further comprising a housing cover removably mounted to said mounting base and enclosing said lamp socket and said ballast.

6. The integrated fixture of claim 5, wherein said lamp socket is recessed within an aperture formed in said housing cover.

7. The integrated fixture of claim 5, further comprising a plurality of vents formed in said housing cover to facilitate the dissipation of heat from within said housing cover.

8. The integrated fixture of claim 5, further comprising an access opening formed in said housing cover to facilitate installation and servicing components within the interior of said housing cover.

9. The integrated fixture of claim 1, further comprising a light diffuser coupled to said base, proximate said lamp socket.

10. The integrated fixture of claim 9, wherein said light diffuser comprises a bottom wall and a pair of spaced, confronting sidewalls extending therefrom, in directions away from a plane including said bottom wall, to define an open end opposite said bottom wall, and open sides adjacent said bottom wall.

11. The integrated fixture of claim 1, wherein said mounting base has a substantially flat bottom surface to facilitate heat dissipation from said mounting base to a surface upon which the mounting base is secured.

12. An integrated fixture for a high intensity discharge lamp, comprising:

a mounting base;

a high intensity discharge lamp socket mounted on said mounting base;

a lamp ballast secured to said mounting base and operatively coupled to said lamp socket;

a heat shield secured to said mounting base and disposed between said lamp socket and said lamp ballast;

a housing cover removably mounted to said mounting base and enclosing said lamp socket and said ballast;

an access opening formed in said housing cover to facilitate installation and servicing components within the interior of said housing cover; and a second heat shield secured to said mounting base and disposed between said ballast and said access opening.

13. An outdoor illuminated sign, comprising:

a sign support frame;

at least one translucent or transparent panel secured to said sign support frame and having visible indicia thereon;

a lamp fixture secured to said sign support frame at a position to provide light through said panel, said lamp fixture comprising:

a mounting base, a high intensity discharge lamp socket secured to said mounting base, a lamp ballast secured to said mounting base and operatively coupled to said lamp socket, and a heat shield secured to said mounting base and disposed between said lamp socket and said lamp ballast; and a high intensity discharge lamp operatively coupled to said lamp socket.

14. The outdoor illuminated sign of claim 13, wherein said lamp fixture is disposed adjacent said panel at a position other than a peripheral edge of said panel.

15. The outdoor illuminated sign of claim 13, comprising a plurality of said lamp fixtures secured to said sign support frame and arranged in a matrix at various positions on said sign support frame to provide light through said panel.

* * * * *